US006122838A

United States Patent [19]

Bloemendaal

[11] Patent Number: 6,122,838

[45] Date of Patent: Sep. 26, 2000

[54] METHOD AND APPARATUS FOR DRYING GRAIN

[75] Inventor: Brent J. Bloemendaal, Zionsville, Ind.

[73] Assignee: Beard Industries, Frankfort, Ind.

[21] Appl. No.: 09/392,864

[22] Filed: Sep. 9, 1999

[51] Int. Cl.[7] ..... F26B 7/00

[52] U.S. Cl. ..... 34/435; 34/482; 34/65; 34/167; 34/168; 34/174; 34/210; 34/215; 34/436

[58] Field of Search ..... 34/428, 435, 436, 34/482, 487, 511, 64, 65, 66, 167, 168, 174, 175, 209, 210, 215, 218

[56] References Cited

U.S. PATENT DOCUMENTS 4,064,638 12/1977 Stanfield ..... 34/174
4,149,844 4/1979 Noyes et al. .
4,249,892 2/1981 Noyes et al. .
4,404,756 9/1983 Noyes ..... 34/65
5,467,535 11/1995 Lentz ..... 34/168
5,992,044 11/1999 Hanig ..... 34/434

*Primary Examiner*—Pamela A. Wilson
*Attorney, Agent, or Firm*—Henderson & Sturm LLP

[57] ABSTRACT

A method and apparatus for drying grain which includes a method and apparatus for unloading the grain from a grain dryer of a type including spaced apart first and second walls for defining a passageway or grain column for directing grain flowing downwardly by gravity between the first and second walls. A substantially horizontal shelf is disposed below the outlet port of the grain confinement walls for receiving grain thereon from the grain column. A channel is disposed below the shelf for receiving grain which is pushed off of the shelf. A discharge port is disposed in the channel. A strip of material is disposed for moving along above the shelf for metering grain from the shelf to the channel as the strip moves along the shelf. A paddle is disposed for movement in the channel for pushing grain from the channel into the discharge port. The dryer also has a central air passage from top to bottom, which lends itself to being used for three mode drying, if desired.

22 Claims, 6 Drawing Sheets

METHOD AND APPARATUS FOR DRYING GRAIN

CROSS-REFERENCE TO RELATED APPLICATIONS

Not Applicable

STATEMENT REGARDING FEDERALLY SPONSORED RESEARCH OR DEVELOPMENT

Not Applicable

BACKGROUND OF THE INVENTION

1. Field of the Invention

This invention relates generally to grain dryers, and more particularly to a method and apparatus for unloading grain from grain dryers after it has been dried.

2. Description of the Related Art

Continuous flow tower grain dryers such as those shown in U.S. Pat. Nos. 4,149,844 and 4,249,891, which are incorporated herein by reference, generally have a column which goes completely around the dryer for receiving grain by gravity therethrough. Such dryers have a plenum divider which can determine a heat suction and a cooling suction so as to force cool air through the grain after it has been heated with hot air, for example. These dryers preferably have three modes. There can be (1) pressure heat, vacuum cool, (2) pressure heat, pressure cool and (3) full heat. It is desirable to have a tower dryer which has all three modes, but such is not necessary if a user only desires to use one or two of such modes.

To unload the grain from a continuous flow dryer of the aforementioned type, there have been sweep augers which rotate around the circumference of the floor which pull grain to a center takeaway auger and then through a discharge auger. This auger-type unloading system is expensive and requires maintenance. The auger-type unloading system also causes some reduced quality of the grain being moved, with some damage to the grain from the augers resulting in an economic loss.

In prior art sweep augers often evacuate grain faster than the void gets filled. This causes a hammering effect which stresses the metal sheets of the dryer.

Consequently, there is a need for an improved grain unloading system and method for a continuous flow grain dryer to overcome the disadvantages of the prior art.

BRIEF SUMMARY OF THE INVENTION

The present invention relates to a method and apparatus for drying grain including a method and apparatus for unloading the grain from a grain dryer of a type including spaced apart first and second perforated grain confinement walls for defining a passageway for directing grain flowing downwardly by gravity between the first and second walls. A substantially horizontal shelf is disposed below an outlet port of the grain confinement walls for receiving grain thereon from the passageway. A channel disposed below the shelf for receiving grain which is pushed off of the shelf and a discharge port is disposed in the channel for receiving grain from the channel. A strip of material is disposed for moving along above the shelf for metering grain from the shelf as the strip moves along the shelf. A paddle is disposed in the channel for movement in the channel for pushing grain into the discharge port.

An object of the invention is to provide an improved grain dryer and method of drying grain.

Another object of the present invention is to provide an improved grain unloading system for grain dryers.

Still another object of the present invention is to provide an unloading method and apparatus for grain dryers which is dependable and unloads evenly around the periphery of the dryer.

Another object is to provide a dryer with a central air passage above the entry of air from the fan which extends substantially the length of the grain column.

A still further object of the present invention is an apparatus which can unload large volumes of grain at low speeds.

A still further object of the invention is a grain unloading method and apparatus which is easily fabricated and which functions smoothly.

A still further object of the present invention is to provide an unloading method and apparatus which allows the bottom of the grain dryer to open up for fan ducting and service access.

A still further object of the present invention is an unloading method and apparatus for grain dryers which permits the closing off of the return air.

Other objects, advantages, and novel features of the present invention will become apparent from the following detailed description of the invention when considered in conjunction with the accompanying drawings.

DETAILED DESCRIPTION OF THE INVENTION

Figure 1:
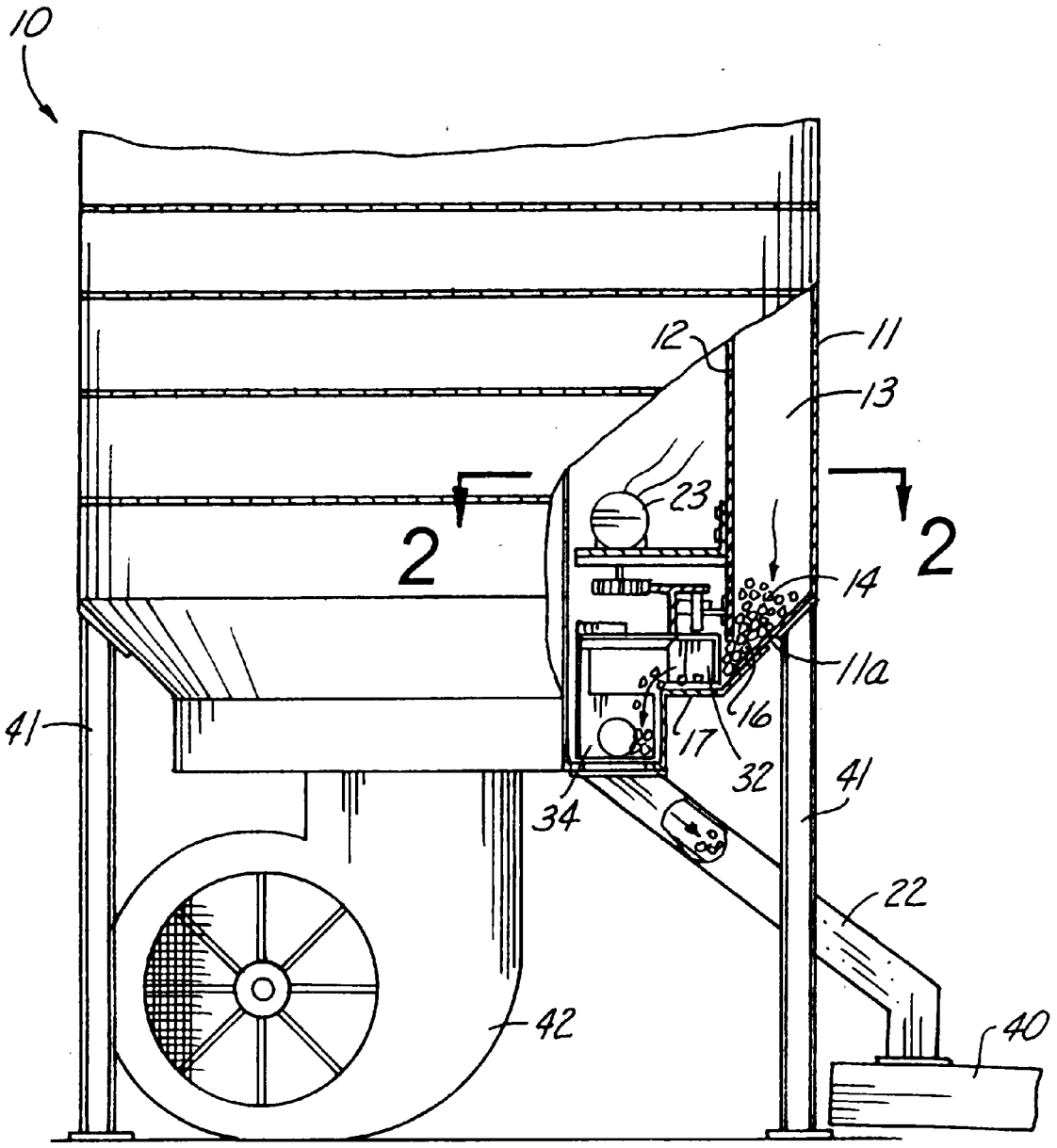
FIG. 1 is a side elevational view of a preferred embodiment of the present invention showing a continuous flow tower dryer with a portion thereof broken away and showing a cross section of the unloading system of the present invention.

Referring now to the drawings, wherein like reference numerals designate identical or corresponding parts throughout the several views, FIG. 1 shows a grain dryer (10) constructed in accordance with the present invention and having a circular outer perforated metal skin (11) and an inner perforated metal skin (12) forming a column (13) to guide grain (14) therethrough. The bottom of the column (13) tapers by conical portion (11*a*) which typically would not be perforated, although it could be. The grain is directed by gravity through the walls (11) and (12) and down to an outlet port (16) at the bottom of the conical walls (11*a*) and (12*a*).

The grain from the outlet port (16) falls on a shelf (17) and the grain which is pushed off of the shelf (17) falls into a channel defined by a floor (18) and upright walls (19) on the outside and (20) on the inside. A discharge chute (22) is disposed in the bottom floor (18) of the channel formed by sidewalls (19) and (20) in floor (18).

Figure 2:
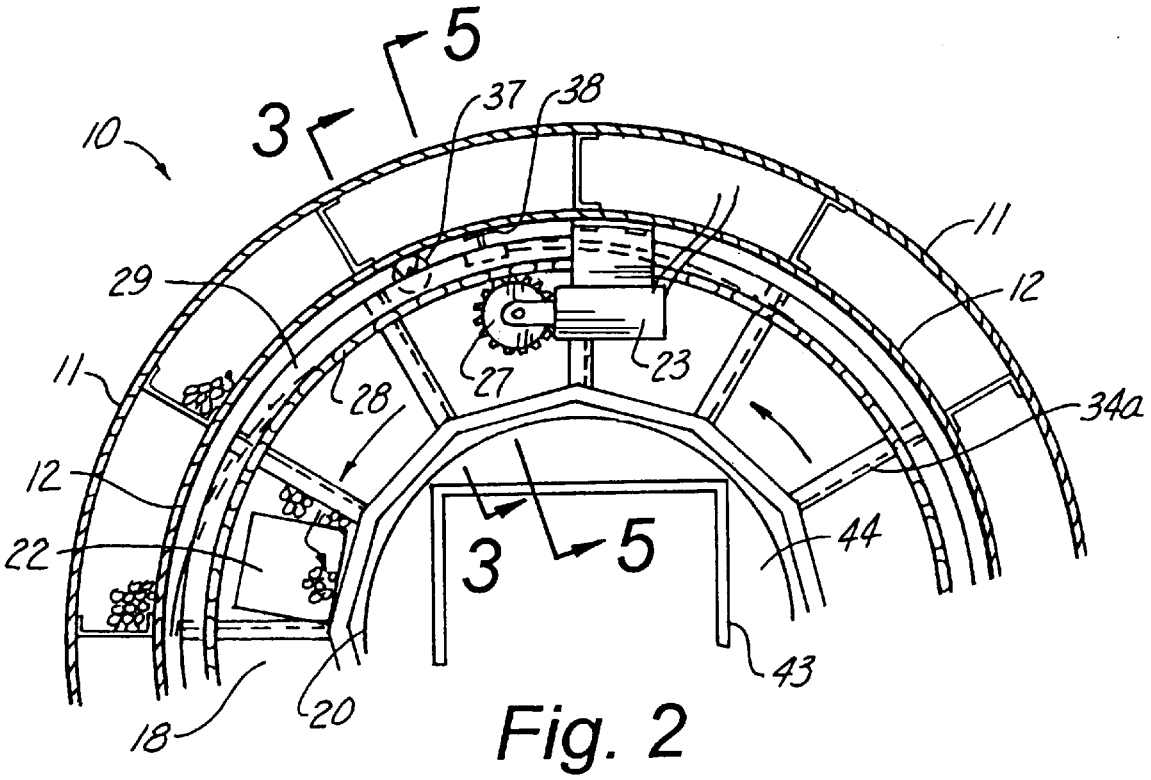
FIG. 2 is an enlarged cross sectional view taken along line 2—2 of FIG. 1 and showing from the top down the grain column, a shelf on which the grain moves by gravity, strips of material which meter the grain off of the shelf into a channel to a discharge port.
Figure 3:
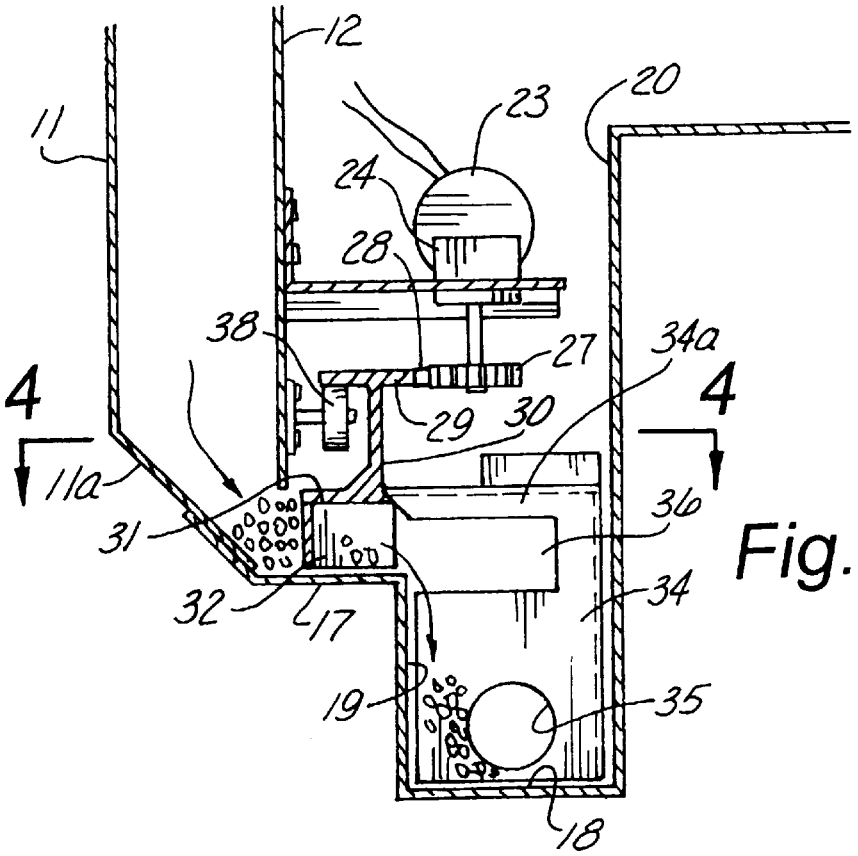
FIG. 3 is an enlarged cross sectional view taken along line 3—3 of FIG. 2 and showing how the grain moves from the grain column to the shelf and how it is pushed off the shelf by strips of material into a channel where paddles push the grain into the discharge chute.
Figure 4:
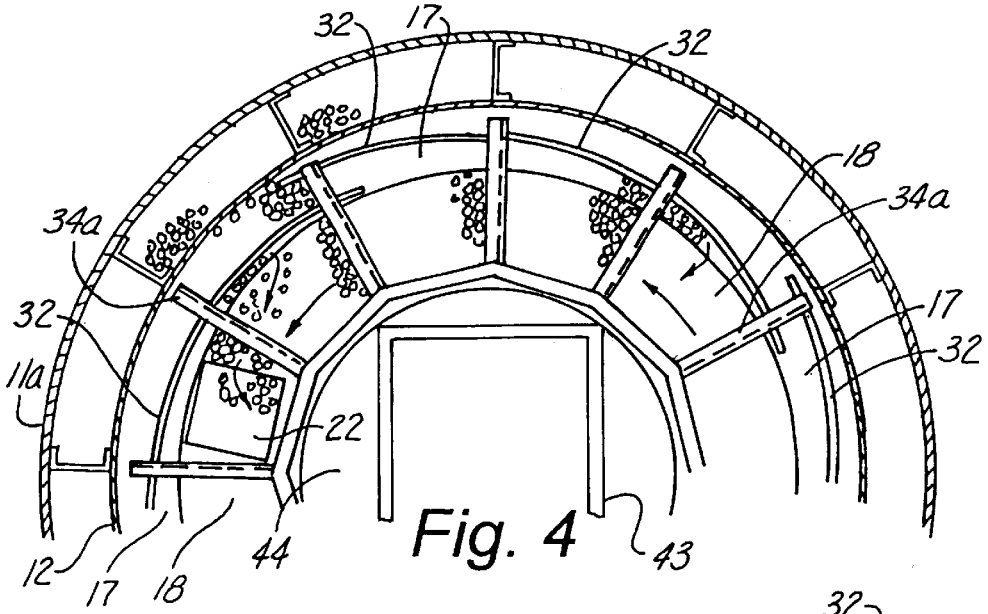
FIG. 4 is a cross sectional view taken along line 4—4 of FIG. 3 and showing the process in more and closer detail.
Figure 5:
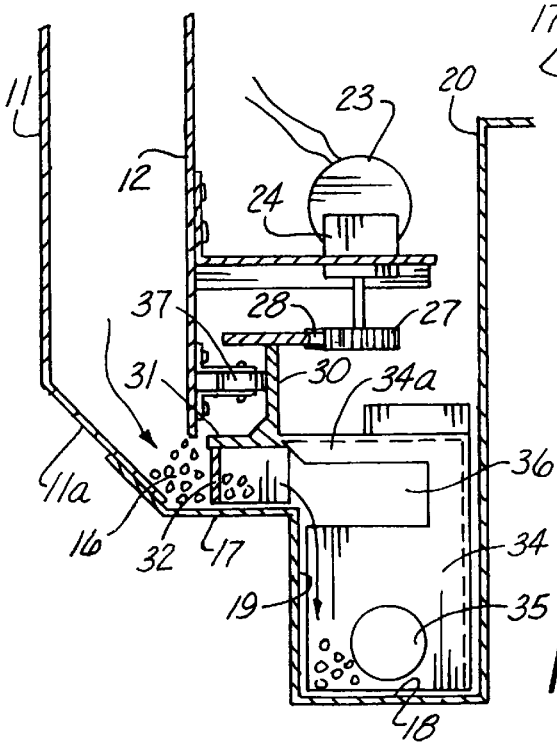
FIG. 5 is a cross sectional view taken along line 5—5 of FIG. 2.

Referring to FIGS. 2 and 3, an electric motor (23) is shown which has a gear box (24) with an outlet shaft (26) to rotate a sprocket (27). The sprocket (27) has teeth thereon which meshes with teeth (28) on a ring (29) which extends 360° around the bottom of the dryer (10). This ring (29) is therefore driven by the motor (23) and gear (27) as is necessary. The ring (29) has a member (30) disposed thereon and this member (30) also has a lower ring (31) thereon. Strips of UHWW plastic (32) are connected to the member (31) in a pattern which can best be seen in FIGS. 4 and 5. As the members (29), (30), (31) and (32) are rotated in a counterclockwise circle, it can be seen, for example in FIGS. 4 and 5, how the strips (32) push the grain off of the shelf (17). At the same time that the strips (32) are pushing the grain (14) off of the shelf (17), a paddle (34) is rotating with the members (29), (30), (31) and (32), because the paddle (34) is attached at the top portion (34*a*) thereof to member (31).

The paddles (34) have an opening (35) therein in the middle thereof so that grain can pass therethrough rather than build up in front of the paddle (34). Similarly, a slot (36) is disposed at the top portion of the paddle (34) for a similar reason wherein if the grain becomes too high within the channel defined by walls (18), (19) and (20), the grain can flow over the top and through the openings (36).

Rollers (37), which rotate about a vertical axis, are disposed in spaced positions around the circumference of the dryer to guide the circumferential member (30) and reduce friction in the process. Similarly, a plurality of rollers (38) are mounted for rotation about a horizontal axis to help guide and reduce friction to the top plate or ring (29) as it rotates. Other rollers can be added or subtracted too and other ways of mounting the strips (32) and paddles (34) can be used if desired rather than the preferred embodiment shown therein. Similarly, the paddle design (34) can be substantially changed without departing from the present invention.

In operation, the dryer (10) dries grain in a conventional fashion which can be anyone of the modes referred to in the Background of the Invention above, or in other modes which might be contemplated by those skilled in this art. As the grain (14) passes down through the inner and outer walls (12) and (11) respectively, and down through the outlet opening (16), the grain will fall onto the shelf (17) and be metered gradually off of the shelf (17), for example as shown in FIGS. 1–5. The strips (32) which can be made of any suitable material, rather than the preferred UHWW plastic material, not only pushes the grain off of the shelf (17), but also prevents the grain coming from the grain column and outlet port (16) from uncontrolled flow into the channel defined by the walls (18), (19) and (20). The grain is gradually stripped off of the shelf (17) by each successive strip (32) as they rotate around the bottom of the dryer (10). After the grain is pushed or metered off of the shelf (17) and flows into the channel defined by walls (18), (19) and (20), the plurality of paddles (34), which are rotating with the metering strips (32), push the grain ahead of the paddles and when the grain gets to the discharge port (22), it drops downwardly (as can best be seen in FIG. 1) into a discharge conveyor (40). This discharge conveyer (40) takes the grain to whatever destination is desired.

Figure 6:
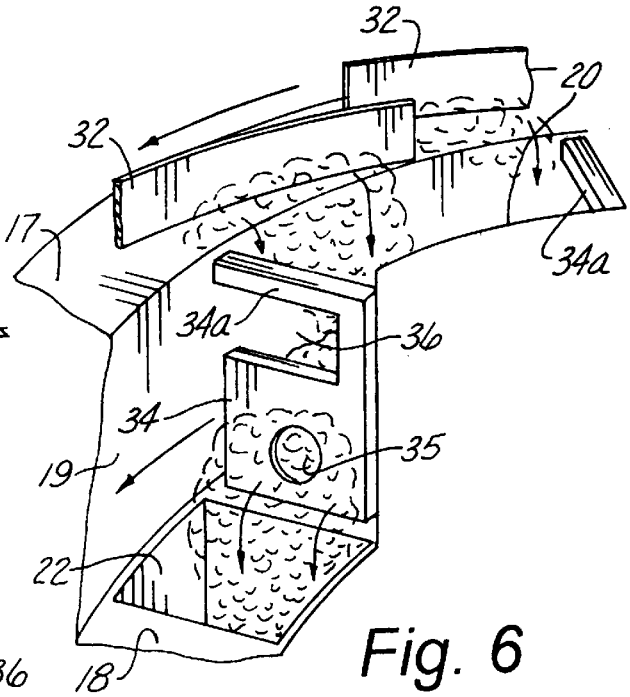
FIG. 6 is a perspective view showing the metering strips pushing grain off of the shelf and into the channel while at the same time paddles are pushing the grain in the channel into the discharge chute.
Figure 7:
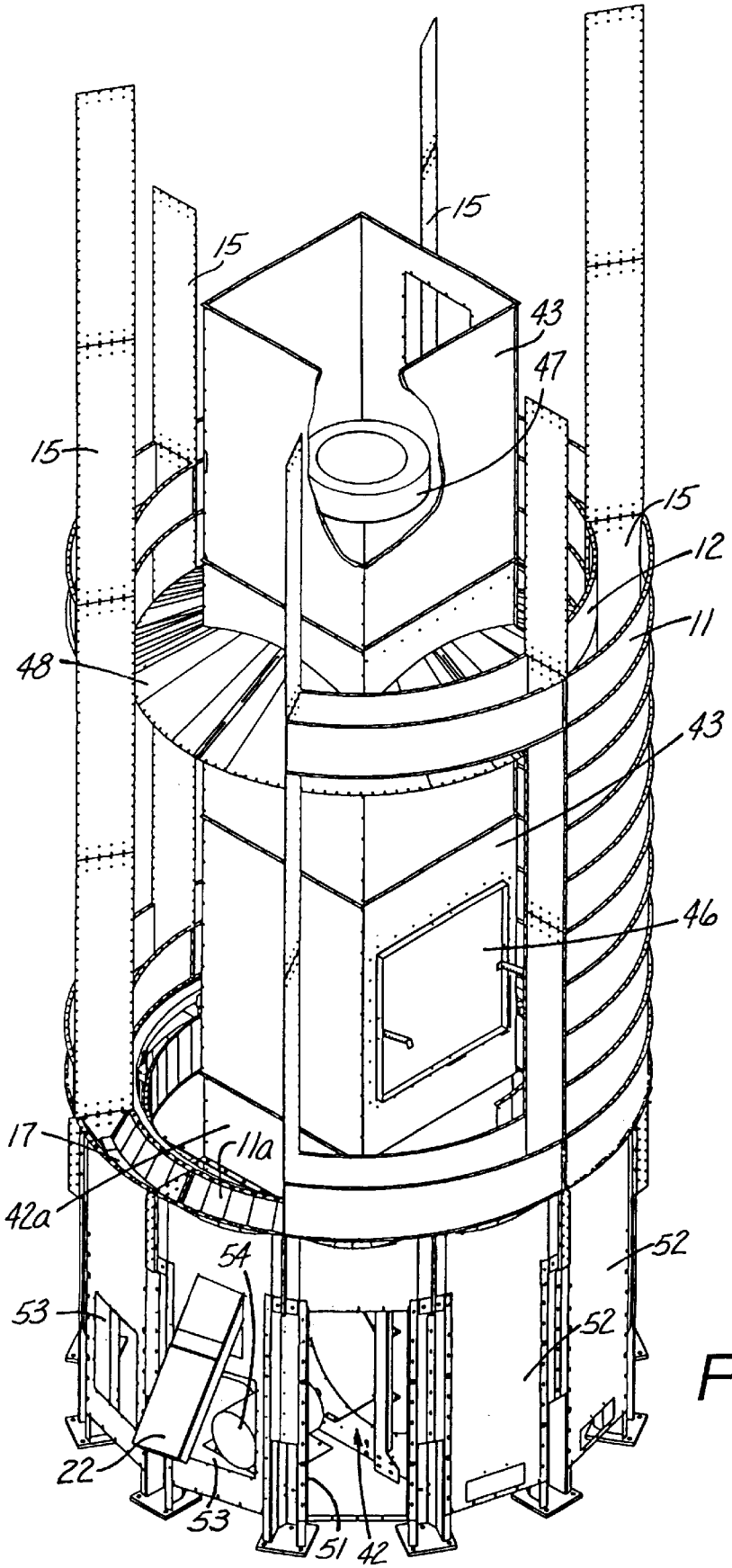
FIG. 7 is a partial perspective view showing a center air flow with a portion broken away to show a burner inside, an air splitter door in the center air flow passage for three mode drying and a plenum divider between the center airflow passage and the inner perforated wall of the grain column passageway.
Figure 8:
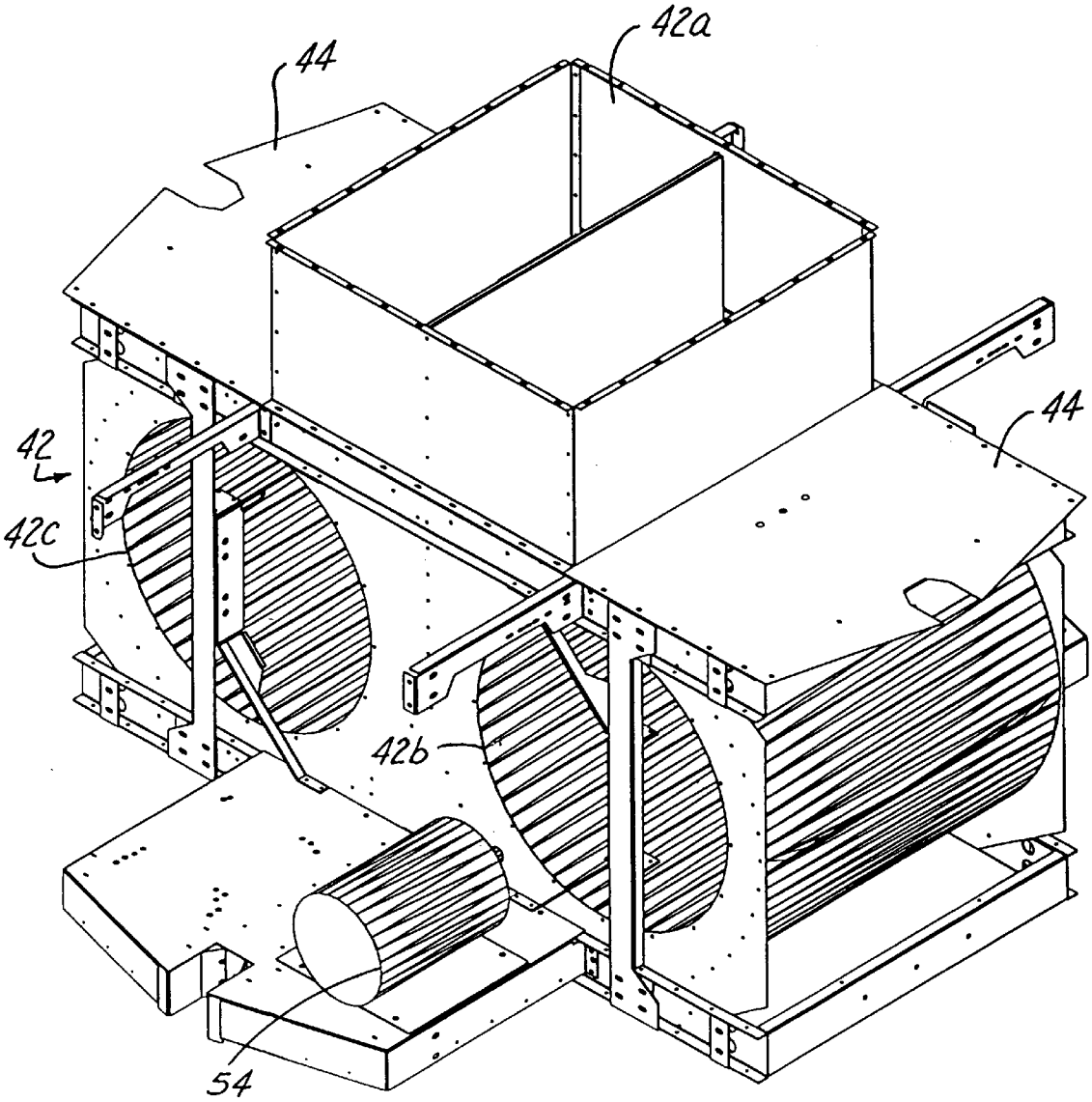
FIG. 8 is a perspective view of the fan and motor sub-assembly.
Figure 9:
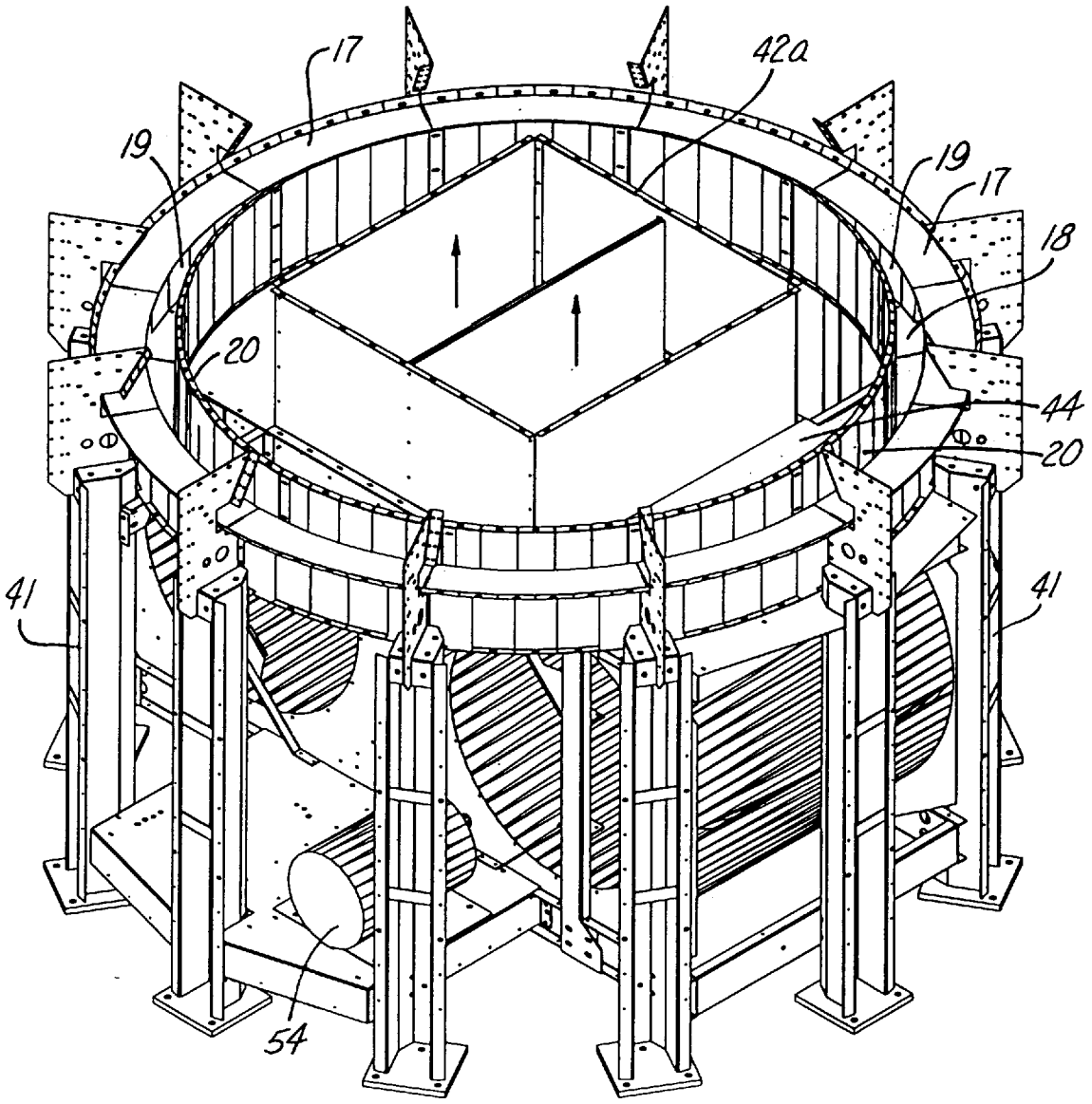
FIG. 9 is a partial perspective view of the bottom portion of the dryer, showing how the fan and motor sub-assembly fits therein, with the inner and outer walls that form the grain column being removed to show a shelf for metering grain to an annular channel.

FIGS. 6–8 show how the unloading system described above makes it possible to have a central airflow passage, with the fan disposed directly below the tower dryer, if desired. This allows the dryer to be used in any one of the aforementioned three drying modes. It is to be understood that even if the dryer is used for less than all three modes, the design of the dryer is economically important because a manufacturer can have the one basic dryer design and then deliver to a customer the capability of drying all three modes, or a dryer that has less than three modes which could be easily modified later to include three mode drying. So manufacturing a dryer of this top to bottom center air passageway design with less than three modes would still be built according to the teachings of this invention, as specified in the claims below. This is true whether the fan is located directly under the central passageway, or the fan outlet is ducted to the extreme bottom of such air passageway. It is a peripheral grain unloading system that does not use all of the center space below the dryer that allows the central air passageway to go from the top to the bottom of the grain column. While a round tower dryer is shown, this type of unloading system could also be used with some modifications in a stacked modular or low profile continuous flow or batch dryer, i.e. with dryers that are not necessarily always continuous flow and which might have opposing grain columns but those which do not go completely around the dryer.

In FIG. 7 a fan assembly (42) is shown having a motor (54). Air is forced up through the two air outlets (42*a*) when the motor turns the fan scrolls (42*b*) and (42*c*), as is shown in FIG. 8. Plates (44) around the periphery of outlets (42*a*) attach to wall (20).

FIG. 6 shows duct (43) that sealingly attaches to fan outlet (42*a*) and extends upwardly the entire height of the dryer (10). Plenum dividers (48) are provided to selectively divide the plenum chamber into an upper and a lower part for heat and cool drying modes. A burner (47), which is shown as circular but which is preferably square like the shape of duct (43) is disposed in duct (43) for providing drying heat as desired.

An air splitter door (46) is disposed in the duct (43) to allow the three modes of drying referred to above and adjustable lower openings (53) are provided to control free air to fans (42*b*) and (42*c*). These lower openings (53) are used to alter the amount of air drawn through the grain in the cooling chamber to control the temperature of the discharged grain.

Panels (52) seal the bottom of the dryer around the fan assembly (42). An access opening (42) has a door (not shown) for also sealing like panels (52).

Accordingly, it will be appreciated that the preferred embodiment disclosed herein does indeed accomplish the aforementioned objects. Obviously many modifications and variations of the present invention are possible in light of the above teachings. It is therefore to be understood that, within the scope of the appended claims, the invention may be practiced otherwise than as specifically described.

I claim:

1. A grain dryer comprising:

spaced apart inner and outer perforated walls having a vertical component for defining a passageway for directing grain flowing downwardly by gravity between the inner and outer walls, said inner and outer walls each having a lower edge defining a grain outlet port between said edges;

a substantially horizontal shelf disposed below said outlet port for receiving grain thereon from said passageway;

a channel disposed below said shelf for receiving grain which moves off of the shelf;

a discharge port disposed in said channel for receiving grain from said channel;

a strip of material disposed for movement above and along said shelf for metering grain from the shelf to the channel; and a paddle in said channel disposed for movement in the channel for pushing grain into said discharge port.

2. The grain dryer of claim 1 wherein said inner and outer walls extend three hundred and sixty degrees.

3. The grain dryer of claim 2 wherein said shelf is substantially annular.

4. The grain dryer of claim 3 wherein said channel is substantially annular.

5. The grain dryer of claim 4 wherein said strip of material is closer to the outlet port at one end than it is at the other end and moves in a circular path along the shelf from said one end to said other end whereby the grain on the shelf is pushed off of the shelf by the strip into the channel.

6. The grain dryer of claim 5 wherein said paddle moves in a substantially circular path along said channel to push the grain into the discharge port.

7. The grain dryer of claim 6 wherein a plurality of overlapping strips of material are disposed above said shelf for metering grain from the shelf and into said channel while preventing unrestricted flow grain from the outlet port to the channel.

8. The grain dryer of claim 6 including a plurality of paddles disposed for movement in a circular path in said channel.

9. The grain dryer of claim 7 wherein said grain dryer is a continuous flow dryer.

10. The grain dryer of claim 7 wherein said strips of material and paddles are connected together whereby they move simultaneously as a single unit.

11. The grain dryer of claim 9 wherein said grain dryer is a tower dryer.

12. The grain dryer of claim 2 including a central air duct disposed radially inwardly of the inner walls, said air duct extending below the grain outlet port.

13. The grain dryer of claim 12 including a heater in said central air duct.

14. The grain dryer of claim 12 including a plenum divider selectively disposed between said central air duct and said inner wall.

15. The grain dryer of claim 14 including an air splitter door in said air duct below said plenum divider.

16. The grain dryer of claim 15 including means for controlling the amount of free air to the fans thereby controlling the amount of air drawn through the grain in a cooling chamber portion of the grain column whereby the temperature of the grain at the discharge port can be controlled.

17. The grain dryer of claim 1 wherein said paddle has an opening therein to prevent a buildup of grain in front of the paddle.

18. The grain dryer of claim 1 wherein said strip of material and paddle are connected together whereby they move simultaneously as a single unit.

19. A method of unloading the grain from a grain dryer of a type including spaced apart inner and outer perforated walls having a vertical component for defining a passageway for directing grain flowing downwardly by gravity between the inner and outer walls, said inner and outer walls each having a lower edge defining a grain outlet port between said edges; a substantially horizontal shelf disposed below said outlet port for receiving grain thereon from said passageway; a channel disposed below said shelf for receiving grain which moves off of the shelf; a discharge port disposed in said channel for receiving grain from said channel; a strip of material disposed for movement above and along said shelf for metering grain from the shelf to the channel; and a paddle in said channel disposed for movement in the channel for pushing grain into said discharge port, said method comprising:

placing grain in said dryer between said inner and outer walls;

drying the grain between said walls with air and heat;

metering the grain out of said outlet port onto said shelf and into said channel with said strip; and moving said grain in the channel into said discharge port with said paddle.

20. The method of claim 19 including blowing air from the center of the grain dryer at a position below the grain outlet port.

21. A grain dryer comprising:

spaced apart inner and outer perforated mostly vertical walls forming a grain column and having lower edges defining an outlet port;

an air duct disposed between portions of the inner walls, said air duct having an air inlet below the grain outlet port and below the lowest portion of the perforated inner and outer walls;

a space between said air duct and the inner walls comprising a plenum chamber;

a plenum divider for dividing said plenum chamber into a top part and a bottom part;

a fan operatively attached to said air inlet of the air duct for blowing air into the air duct from the lower central portion of the dryer; and a heater operatively associated with said air duct for permitting the air in the air duct to selectively be heated.

22. The grain dryer of claim 21 including a grain unloading mechanism at the outlet port which is disposed radially outwardly from said air duct so that it will not prevent the air inlet from being centrally located below the grain outlet port.

* * * * *